US007246762B2

(12) United States Patent
VanHouten et al.

(10) Patent No.: US 7,246,762 B2
(45) Date of Patent: Jul. 24, 2007

(54) PROCESS OF FORMING CORN FLAKING GRITS OF IMPROVED QUALITY WITH MINIMIZATION OF PRODUCTION OF CORN DOUBLES

(75) Inventors: Michael VanHouten, Carmel, IN (US); Curtis Miller, Pari, IL (US); Fritz L. Piel, Carmel, IN (US)

(73) Assignee: Cargill, Incorporated, Wayzata, MN (US)

( * ) Notice: Subject to any disclaimer, the term of this patent is extended or adjusted under 35 U.S.C. 154(b) by 665 days.

(21) Appl. No.: 10/827,516

(22) Filed: Apr. 20, 2004

(65) Prior Publication Data

US 2004/0258814 A1 Dec. 23, 2004

Related U.S. Application Data

(60) Provisional application No. 60/464,332, filed on Apr. 21, 2003, provisional application No. 60/464,321, filed on Apr. 21, 2003.

(51) Int. Cl.
*B02B 5/00* (2006.01)

(52) U.S. Cl. ..... 241/6; 241/12

(58) Field of Classification Search ..... 241/6, 241/7, 8, 9, 11, 12, 13
See application file for complete search history.

(56) References Cited

U.S. PATENT DOCUMENTS 2,801,176 A 7/1957 Ozai-Durrani
3,476,326 A * 11/1969 Rado et al. ..... 241/73
3,661,593 A 5/1972 Christianson et al.
4,581,798 A * 4/1986 Yamamoto ..... 451/541

FOREIGN PATENT DOCUMENTS

WO WO 2004/041434 A1 5/2004

* cited by examiner

*Primary Examiner*—Faye Francis

(57) ABSTRACT

A process for milling corn comprises mixing water and corn kernels to provide a tempering mixture; holding the tempering mixture for a time and temperature effective for lifting hull off from the endosperm of the corn kernels, but a time and temperature which is not effective for moisture to substantially penetrate into the endosperm of the corn kernels; and abrasively removing germ and bran from the moistened tempered corn of the corn kernels. In one embodiment, whole corn kernels are separated into large kernel and small corn components and the large and small corn components are milled separately.

25 Claims, 4 Drawing Sheets

PROCESS OF FORMING CORN FLAKING GRITS OF IMPROVED QUALITY WITH MINIMIZATION OF PRODUCTION OF CORN DOUBLES

CROSS REFERENCE TO RELATED APPLICATION

This application claims benefit under 35 U.S.C. § 119(e) to provisional application No. 60/464,321, filed Apr. 21, 2003, and to provisional application No. 60/464,332, filed Apr. 21, 2003, the disclosure of each of which is hereby incorporated by reference.

FIELD OF THE INVENTION

The present invention is directed to the milling of corn which will provide a coin meal in the form of flaking grits in high quality and yield and which reduces the production of undesirable corn doubles.

DESCRIPTION OF RELATED ART

In corn milling, it is known to separate small corn kernels from larger corn kernels, clean them by known means, and then recombine them for milling. In milling, corn is degermed and dehulled and then sent through a series of roller mills and sifters to produce flaking grits, corn cones, and flour. In the production of flaking grits, small corn kernels have created a problem because they can go through the milling process, undergo degerming and dehulling, but will not be split and, except for the removal of germ and hull, appear as whole corn kernels. These corn kernels have an unusually small size and shape and are called "doubles" in the industry and are undesirable to those who utilize flaking grits and cook such grits to make food products such as corn flakes. Doubles contaminate flaking grits, do not cook well, and create "whites" in corn flake cereals which are objectionable.

In corn milling to make grits, such as flaking grits, whole corn kernels typically are tempered with cold water for 15 to 20 minutes. The tempered whole corn then is degermed using rollers with screens. A Beal degerminator is frequently used in this step. The degerminator yields about 50% thrustock and about 50% tail stock. The thrustock is high in germ and bran content, but has some endosperm. The tail stock is high in starch/endosperm content and has a relatively low germ and bran content. After degermination, the thrustock is dried and bran is separated by aspiration or gravity table from the thrustock which then has a more concentrated form of endosperm and germ. The germ in the thrustock is separated from the endosperm/grits by milling, such as roller mills, and sifting. In short, a lot of effort has been exerted in recovering a limited amount of endosperm or grits from the thrustock. Moreover, drying the thrustock and aspirating bran are energy-intensive operations.

In prior art milling operations, the tail stock from the degerminator generally has been milled and sifted downstream from the degerminator. As a result of more than one milling and sifting operation on the tail stock downstream of the degerminator, corn grits of varying in size and fat content have been made. These operations on the tail stock not only have made grits of varying size, but also have reduced the yield of large sized grits, such as flaking grits. Moreover, because grits of varying size ranges have been made, the yield per bushel of corn of large grits has been lower than if grits of one large grit size range is made.

SUMMARY OF THE INVENTION

A process of milling corn comprises mixing water and corn kernels to provide a tempering mixture. The tempering mixture is held for a time and temperature which are effective for lifting hull off from the endosperm of the corn kernels, but which are not effective for moisture to substantially penetrate into the endosperm of the corn kernels. Germ and bran are abrasively removed from the moistened tempered corn of the corn kernels by rubbing the moistened tempered corn against at least one screen to provide not more than 35 wt % thrustock, not more than 10 wt % bran, and at least 65 wt % tail stock. The thrustock has at least 8 wt % fat and the tail stock has less than 1.75 wt % fat.

The tail stock usually has a flaking grit stream and a tail corn stream. The tail corn stream has a particle size of at least about 5,664 μm. The tail corn stream can be sized to a flaking grit size which is smaller than about 5,664 μm and larger than about 3,987 μm, and the process yields at least about 25 wt % flaking grits based upon the weight of corn kernels after cleaning and prior to milling.

Optionally (though preferably) small corn kernels are separated from large corn kernels prior to milling. The separated small corn kernel and large corn components preferably are milled separately, with the large corn kernels milled to maximize the production of flaking grits.

BRIEF DESCRIPTION OF THE DRAWINGS

The objects, features, and advantages of the invention will be apparent from the following more detailed description of certain embodiments of the invention and as illustrated in the accompanying drawings in which.

DETAILED DESCRIPTION OF THE INVENTION

Figure 1:
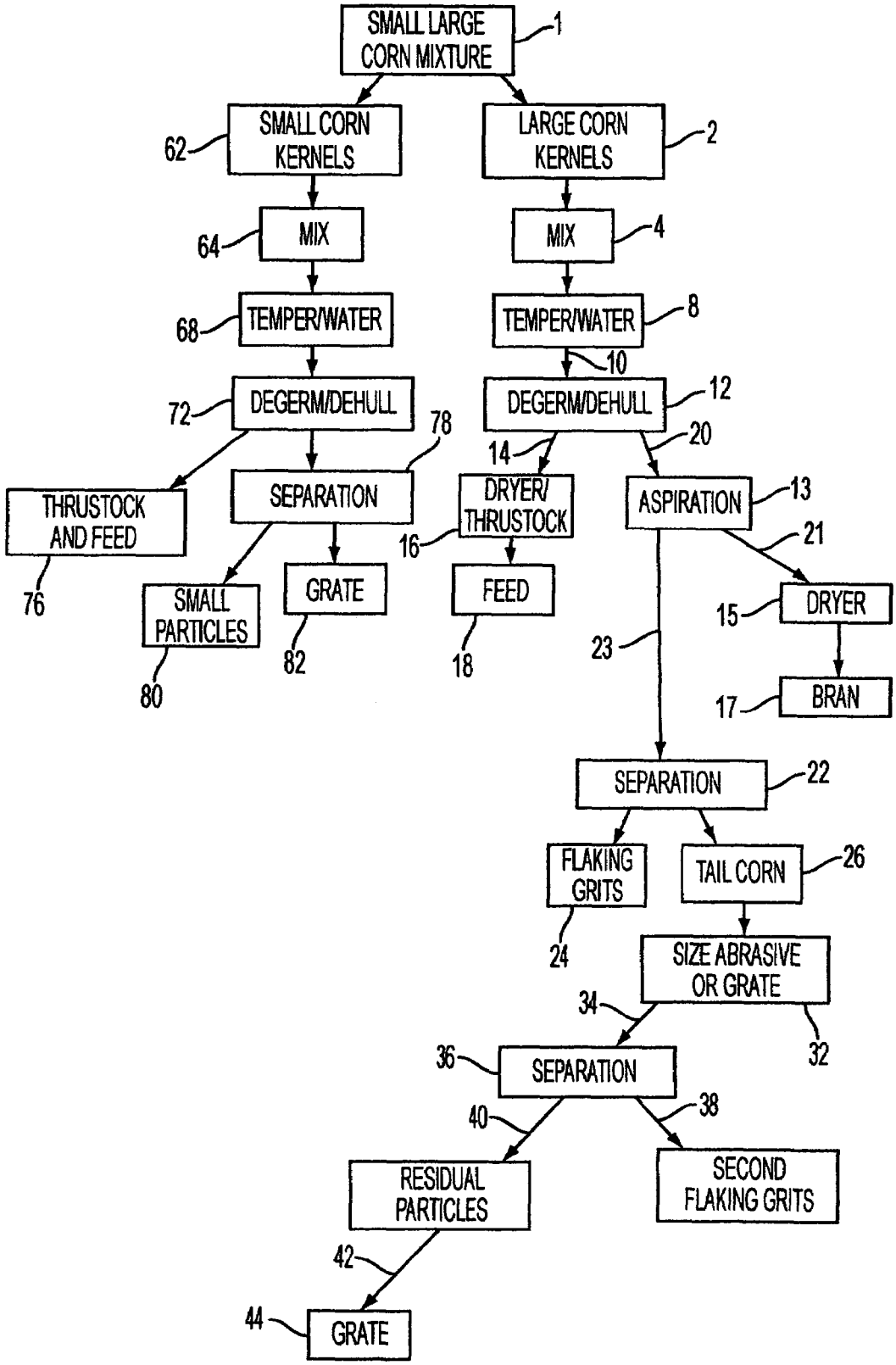
FIG. 1 is a schematic flow chart of a process according to a preferred embodiment.

Unless otherwise clear from context, all weight percentages specified herein are on a dry weight basis. Yield of flaking grits, in terms of weight percent, can be calculated by dividing the weight of flaking grits by the weight of the corn kernel (or large corn component when separated from the small corn component) after cleaning and prior to milling.

The process described herein may be used for processing whole corn kernels. Alternatively, whole corn kernels may be separated into a large corn component and a small corn component. Small corn kernels can be separated from large corn kernels by means known in the art such as by screening and aspirating undesirable materials. After separation each segment is cleaned, although cleaning may occur prior to separation. Usually cleaning prior to separation is not preferred because it tends to be less efficient than cleaning after separation. Typically, the removal of impurities during cleaning reduces the total weight of corn kernels by about 3%.

The separated small corn kernel and large corn components can be milled separately, with the large corn kernels milled to maximize the production of flaking grits. Thereafter, the milled product from the large corn kernels and the small corn kernels may be used separately or recombined if the desired product is smaller than a flaking grit size.

The large corn kernels are mixed with water to temper the corn. If hard corn (e.g., where 90 wt % of the corn kernels have a hardness of at least 58 wt % and generally in the range of from 58 to 65 wt % as measured by a Quaker hardness test) is used, water having a temperature of at least about 80° C., preferably from about 90 to 100° C., should be used to provide the tempering mixture. Corn, such as AgriGold hybrids 6417, 6467 and 6527; Pioneer hybrids 34B97, 33G26, 33Y18, 33J24 and 32H58; Golden Harvest hybrids 8620 and 9229; Beck hybrids 5827 and 6827; Crow-Midwest hybrid 7651; and Cargill hybrid 7110 generally will provide such hardnesses in their kernels. In any event, the tempering mixture is held for a time and temperature which are effective for lifting the hull from the kernel, but not having the temper water substantially penetrating into the endosperm. Moisture penetration should be avoided to avoid drying after tempering. The term "without substantially penetrating the endosperm" means that after tempering the moisture content of the endosperm of the tempered corn is not more than about 1% greater than the moisture content of the endosperm of the corn immediately after harvest, and preferably not more than about 0.5% greater than the moisture content of the endosperm of the corn immediately after harvest. To maximize the yield of flaking grits from the larger corn kernels, the time and temperature for tempering also should be effective for providing at least 65 wt % tail stock from the large corn kernels which comprises less than about 1.75 wt % fat on a dry basis, typically less than about 1.5 wt %. The tail stock may have as much as about 93-98 wt % endosperm, for example at least about 95 wt % endosperm.

The time and temperature of tempering has a significant effect on the ratio of tail stock and thrustock being produced after the first degermination and dehulling. For hard corn, the tempering mixture should be held for at least about 30 seconds, preferably from about 90 seconds to 3 minutes. The temperature of the water being mixed with the corn preferably is at least about 80° C., more preferably from about 90° C. to 100° C., to provide a moistened tempered corn. The moistened tempered corn typically has from about 3 to 4 wt % more moisture than the incoming corn has in its natural harvested state. Steam may be used in lieu of liquid water. It is possible to a temper with water at lower temperatures, e.g., room temperature, which generally requires the use of more water and requires additional time, e.g., about 10 minutes at room temperature. However, lower temperatures generally are not preferred because of the risk of the temper water penetrating into the endosperm.

After tempering, the tempered corn from the large kernels then is degermed and dehulled (which removes bran) by pushing the moistened tempered corn kernels against at least one screen to abrasively remove germ and hull from the kernels. This degermination and dehulling provides not more than about 35 wt % germ and bran rich thrustock from the large corn kernels, but is capable of providing 30 wt % or less thrustock, based upon the hardness of the large corn kernels being degermed and dehulled, and at least 65 wt % endosperm rich tail stock. The thrustock has at least about 8 wt % fat on a dry basis, often from about 10 to 11 wt % fat, and the tail stock typically has less than 10 wt % fat. The germ and hull are removed from the corn kernels by pushing and rubbing the kernels at and against the screen to provide endosperm-rich corn kernels in the tail stock. The endosperm-rich tail stock does not go through the screen, but the germ and bran go through the screen after they are abrasively removed from the corn kernels. Care should be taken not to hit or impact the kernels through the screen, but rather gently abrade the kernels against the screen to dehull and degerm the corn kernels.

In one aspect, screens which form a polygonal sides of a cylinder should have rectangular holes or slits (as opposed to round holes) having a dimensions of about 1 to 3 mm by about 20 to 25 mm. The corn kernels are pushed outwardly from the inside of the polygonal sided cylindrical mill with the corn kernels being pushed by cylindrical-shaped rotating rotors inside the cylindrical-shaped mill which does not have a reduced diameter in the direction from the inlet to outlet of the mill. This milling preferably is done with a Buhler-L Machine (Buhler model number MXHL) which has six flat polygonal sides with rectangular slits and cylindrical-shaped rotors. The cylindrical mill with slits is stationary with the corn kernels being impelled horizontally down the length of the cylinder and outwardly from the longitudinal axis of the cylinder by the rotating cylindrical rotors to the slitted or slotted polygonal sides of the cylinder. Buhler-L Machines are commercially available from Buhler GmbH of Germany.

The abraded, degermed, and dehulled tail stock from the Buhler-L machine is separated from the germ and bran which goes through the screen in the machine and forms the thrustock. The endosperm-rich degermed and dehulled kernels form the tail stock. The tail stock includes a flaking grit stream and a +3½ mesh tail corn stream which is about 100% 3½-mesh (U.S. standard test sieve) or larger (particle size of about 5,664 μm or larger). Preferably, the flaking grit stream has flaking grits with a minimum particle size such that at least 50% of the corn particles remain on a 5-mesh wire screen (U.S. standard test sieve) (3,987 μm×3,987 μm), and not more than 7 weight percent of the particles go through a 14-mesh wire screen (U.S. standard test sieve) (1,410 μm×1,410 μm).

The tail stock can be aspirated prior to separation of the flaking grits. During aspiration, bran which has been loosened from the kernels during degermination is recovered and thereafter dried. The large particles in the remaining tail stock ("clean tail stock") can be further sized and abraded to flaking grit size. The further sizing and abrading may be done by processing corn particles in the tail corn stream through a Buhler-L machine as described above or a Satake VBF grain polishing apparatus. Alternatively, the particles in the tail corn stream may be grated and sized by moving the particles in the tail corn stream over a surface having perforations and cutting edges which result in a "grating" or cutting type of sizing action. The "grating" type of action during the sizing may be done with paddles rotating on a horizontal shaft over a basket assembly which includes a U-shaped screen.

The moving surface and the size of the perforations of the grating apparatus are effective to provide flaking grits from the tail stock corn stream. Generally, the perforations in the grating apparatus are 4 to 7 mm holes with cutting edges or serrations at the periphery of the holes. The size of the perforations or holes in the screen of the basket and the serrations in the screen may be used to determine the size of the resulting grits.

In the aspect of the invention where the tail corn stock produced by abrading the corn kernels against a screen is then again pushed against the screen in a second degermination and sizing step (such as in a Buhler-L machine, to further remove germ and bran), the additional germ and bran removed in this step is separated from large endosperm particles by aspiration and screening. Thereafter, the resulting residual large endosperm particles from the tail corn stream are sized by grating the tail corn stream through perforations and sifting as described above to provide flaking grits in high yield.

The process of milling the large corn kernels is effective for providing at least about 25 wt % yield of flaking grits from the tail stock streams. In prior art process, the yield of flaking grits typically has been no more than 18 to 22 wt %. Preferably, flaking grit yields are at least 30 wt %, more preferably at least 35 wt %, and even more preferably at least 38 wt %. Flaking grit yields as high as 40 or 50 wt % may be possible.

Milling of Small Corn Kernels

After cleaning the small corn kernels, the kernels are degermed in a degerm-inator which can be the same as that described used for the degermination of the large corn kernels. A thrustock and a tail stock stream is created as a result of the degermination. The thrustock is separated from the tail stock with the thrustock being used for feed. Thereafter, the tail stock is sieved or sifted to separate particles of +5 mesh or greater from those corn particulate products with a particle size of smaller than +5 mesh (U.S. mesh sieve size) (3,987 μm). The cornmeal having a particle size of greater than +5 mesh can be grated or cut to a size smaller than +5 mesh (3,987 μm).

Components of the Maize (Corn) Kernel

Botanically, a maize kernel is known as a caryopsis, a dry, one-seeded, nut-like berry in which the fruit coat and the seed are fused to form a single grain. Mature kernels are composed of four major parts: pericarp (hull or bran), germ (embryo), endosperm and tip cap.

An average composition of whole maize, and its fractions, on a moisture-free (dry) basis is as follows:

| Fraction of Whole Maize | Kernel % | Starch % | Protein % | Liquid % | Sugar % | Ash % |
|---|---|---|---|---|---|---|
| Whole grain | 100 | 71.5 | 10.3 | 4.8 | 2.0 | 1.4 |
| Endosperm | 82.3 | 86.4 | 9.4 | 0.8 | 0.6 | 8.3 |
| Germ | 11.5 | 8.2 | 18.8 | 34.5 | 10.8 | 10.2 |
| Pericarp | 5.3 | 7.3 | 3.7 | 1.0 | 0.3 | 0.8 |
| Tip cap | 0.8 | 5.3 | 9.1 | 3.8 | 1.6 | 1.6 |

Germ: The scutellum and the embryonic axis are the two major parts of the germ. The scutellum makes up 90% of the germ, and stores nutrients mobilized during germination. During this transformation, the embryonic axis grows into a seedling. The germ is characterized by its high fatty oil content. It is also rich in crude proteins, sugars, and ash constituents. The scutellum contains oil-rich parenchyma cells which have pitted cell walls. Of the sugars present in the germ, about 67% is glucose.

Endosperm: The endosperm contains the starch, and is lower in protein content than the germ and the bran. It is also low in crude fat and ash constituents.

Pericarp: The maize kernel is covered by a water-impermeable cuticle. The pericarp (hull or bran) is the mature ovary wall which is beneath the cuticle, and comprises all the outer cell layers down to the seed coat. It is high in non-starch-polysaccharides, such as cellulose and pentosans. A pentosan is a complex carbohydrate present in many plant tissues, particularly brans, characterized by hydrolysis to give five-carbon-atom monosaccharides (pentoses). It is any member of a group of pentose polysaccharides having the formula $(C_5H_8O_4)_n$ found in various foods and plant juices. Because of its high fiber content, the pericarp is tough.

Tip cap: The tip cap, where the kernel is joined to the cob, is a continuation of the pericarp, and is usually present during shelling. It contains a loose and spongy parenchyma.

Corn Milling

As used herein, flaking grits means tail stock product which comprises divided corn kernels having a particle size smaller than 3½-mesh (U.S. standard sieve) (about 5,664 μm) and larger than 5-mesh (U.S. standard sieve) (about 3,987 μm), although a person of ordinary skill in the corn milling art will recognize that not more than about 5 wt % of the flaking grits may include smaller sized particles.

As used herein, "small corn kernels" are corn kernels which are not capable of being made into flaking grits. Generally, such small corn kernels are not larger than kernels which will go through a screen with round holes having an 8 mm diameter and will not go through a screen with round holes having a 4 mm diameter.

As used herein, "large corn kernels" are capable of making flaking grits. Generally they will not go through a screen with round holes having an 8 mm diameter.

Specific hybrids of corn having a hardness in the range of from 58 to 65 wt % as measured by a Quaker hardness test method may be used in the process herein. Hardness is measured by sampling 200 grams of corn obtained by a probe which is put into the incoming corn. The corn then is ground in a Quaker Mill, model 4A. Thereafter, 10 grams of the ground corn are sifted on an alpine sifter with US 60-mesh wire. The material that resides on the US 60-mesh wire is weighed and reported in grams times 10. Specific hybrids, such as AgriGold hybrids 6417, 6467 and 6527; Pioneer hybrids 34B97, 33G26, 33Y18, 33J24, and 32H58; Golden Harvest hybrids 8620 and 9229; Beck hybrids 5827 and 6827; Crow-Midwest hybrid 7651; and Cargill hybrid 7110 may be used.

FIG. 1 shows a schematic illustration of a process in accordance with a preferred embodiment of the invention in which hard corn is used. After the large and small corn kernels 1 are separated, the incoming large, hard corn kernels 2 are conveyed into a mixer 4 where water and the corn are mixed. The water and corn mixture then is conveyed via line 6 to a tempering area 8 where the corn kernels are held in water, where the water preferably has a temperature of 90-100° C., for about 90 seconds to 3 minutes. After tempering, the corn is conveyed via conveyer 10 to a degerming, dehulling apparatus 12 which pushes the corn kernels through a cylindrical-shaped mill with flat-sided screens where the hull or bran and germ are abrasively removed from the large corn kernels. The germ and bran go through the screens. The endosperm-rich particles remain on the inside of the cylindrical mill.

The germ and bran are conveyed via line 14 to a dryer 16 for drying. Stream 14 forms thrustock which after drying is conveyed as at 18 for animal feed. The endosperm-rich particles that remain on top of the screen at 12 form the tail stock which is conveyed via line 20 to an aspirator 13. From the aspirator 13, bran which has been loosened from the kernel is recovered and fed via line 21 to a dryer 15 from which bran of high purity (e.g., food grade or near food grade bran) is collected at 17. The remaining tail stock ("clean tail stock") is fed via line 23 for separation via screening at 22 where the clean tail stock is divided into two portions, the flaking grit stream 24 and the tail corn stream 26. The tail corn stream 26 has a large particle size of at least 3½-mesh (about 5,664 μm) and is taken to sizing apparatus 32. The sizing at 32 may be done by abrasively sizing the kernels by pushing the tail corn stream particles against a slotted screen in the same way and using the same type of apparatus used at 12. Alternatively, the tail corn stream may be sized by grating the large particles against holes with cutting-edged perforations to reduce the size of the tail corn stream.

After the tail corn stream is reduced in size, it is taken via conveyor 34 to a screen 36 for separation into a second flaking grit stream 38 and a residual larger particle stream 40. The residual large particles are taken to a sifter/cutting device 44 via line 42, such that the residual, larger particles may be further reduced to flaking grit size. The device 44 has cutting edge perforations which reduce particle size by a grating action. In a preferred embodiment, the first sizing operation at 32 is done with a degerminator, such as a Buhler L machine, and then the residual large particles are grated as at 44.

Figure 2:
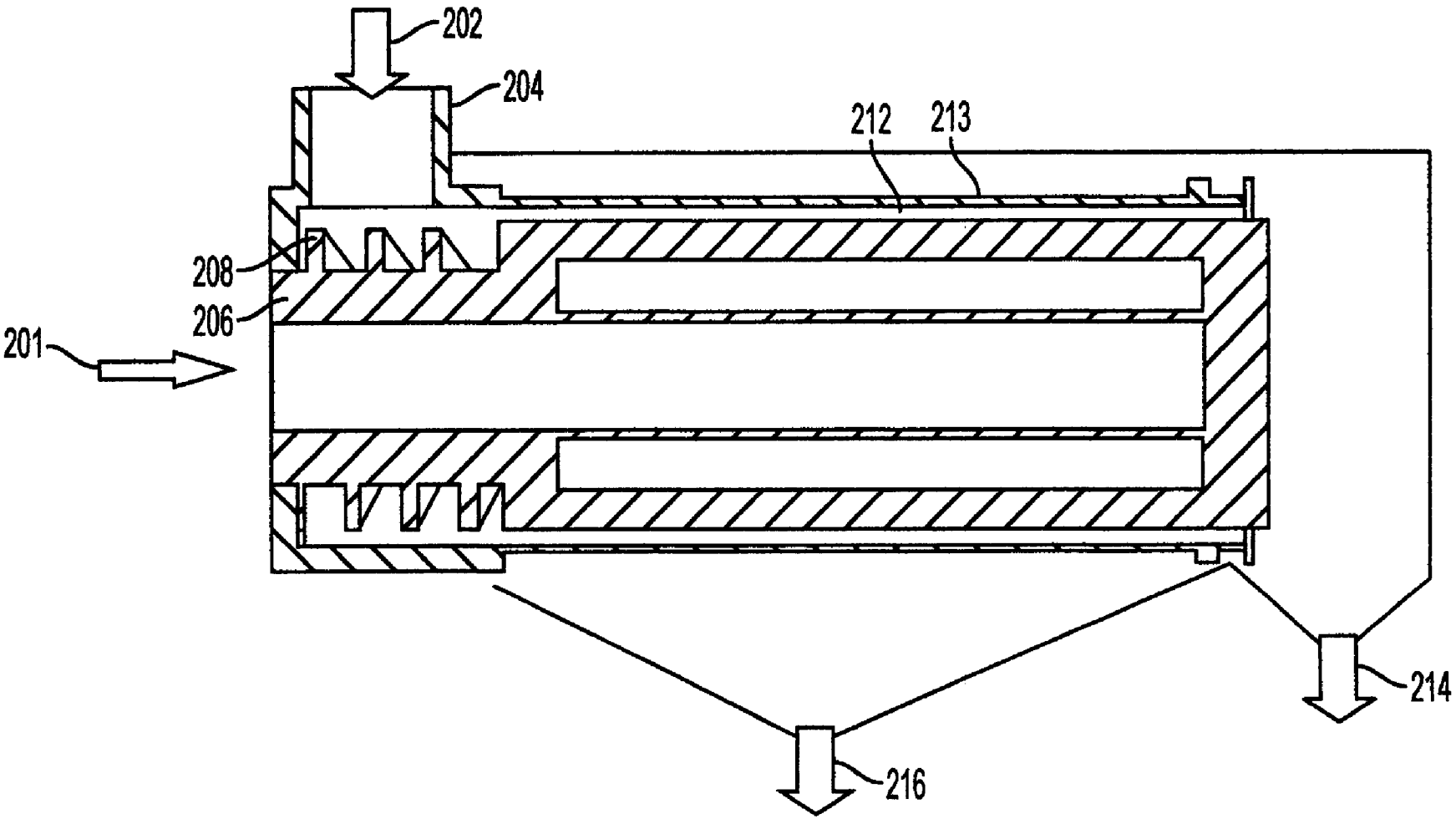
FIG. 2 is a front elevation view of a degerming and dehulling machine with an six-sided screen according to a preferred embodiment.

FIG. 2 is a longitudinal section view of the degerming and dehulling apparatus 12 shown in FIG. 1. Corn kernels are conveyed into the apparatus as seen in 202 through a cylindrical intake pipe 204 which moves the kernels into a horizontal tunnel which has rotating screw 206 going through the tunnel. The rotating screw has longitudinal bars (as seen in cross section at 308) running its length and spiral flights 208 to convey the moist corn kernels into the cylindrical mill 212 which has flat polygonal sides. Air 201 pushes down through into the horizontal cylindrical mill. The corn kernels push down the tunnel by the flights and are rubbed against the flat polygonal screens which form the sides of the cylindrical mill 212. The action of the kernels against these screens abrasively removes the hull and germ which go through the screens and exit the mill at conduit 216 where a pressure plate (not shown) is resiliently mounted, such as with springs, over the exit of the mill to cover the exit of the mill and in part control the pressure being exerted on the corn being pushed against the slits of the mill. The endosperm-rich larger particles stay within the cylindrical mill and convey with the screw down through the tail stock exit 214.

Figure 3:
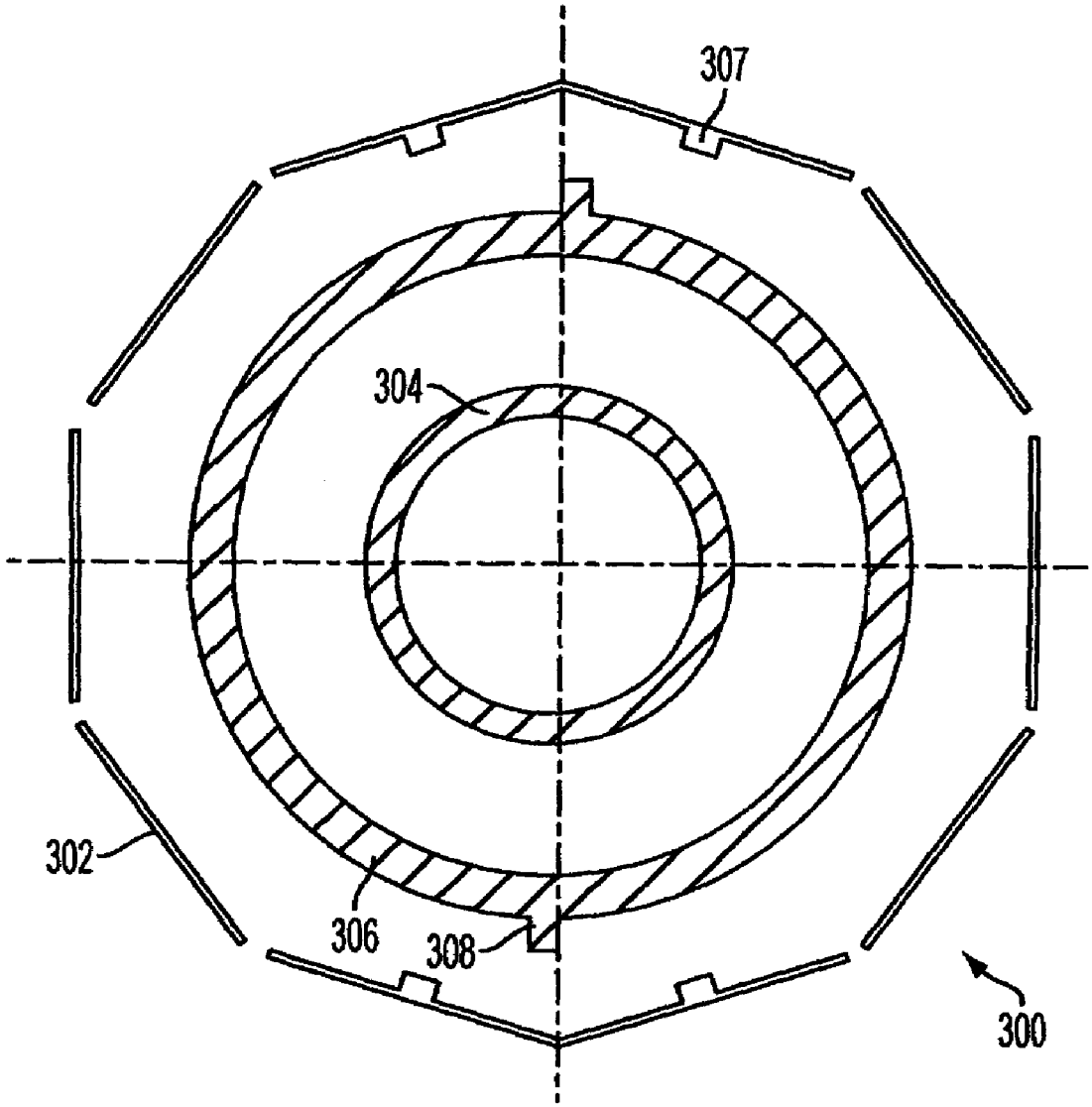
FIG. 3 is a cross sectional view of an six-sided screen of the degerming and dehulling machine of FIG. 2.

FIG. 3 shows a cross section view of the screen-sided cylindrical mill. The polygonal-sided cylindrical mill 300 has flat sides 302 which are screens. Rotating or turning rollers 306 are rotated by axle 304. Nips 308 revolve within the screen and rub the corn kernels against the screen to remove the hull and germ from the corn kernels.

Figure 4:
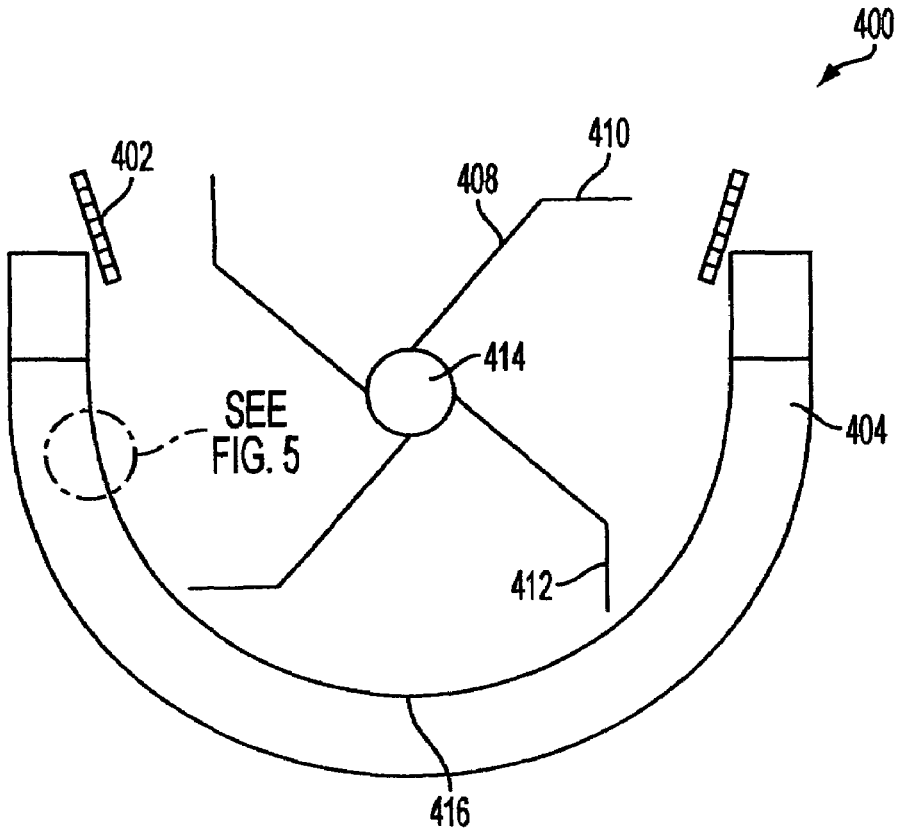
FIG. 4 is a side-cross section of a grating apparatus according to a preferred embodiment.

Referring to FIG. 4, the grating apparatus 400 has an intake conduit 402 to a U-shaped basket 404. A rotating mount 408 has paddles 410 which revolve around shaft 414. The paddles rotate 360° and push the large endosperm-rich corn particles with nip 412 against the serrations 416 formed on basket 404. The rotating action of the paddles push the large endosperm-rich corn particles against the serrations to cut the particles and push them through holes in the basket to reduce the size of the large corn particles.

Figure 5:
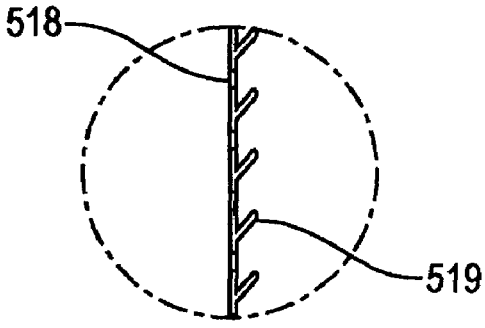
FIG. 5 is an expanded view of the grating surface of the grating apparatus of FIG. 4.

FIG. 5 shows an expanded view of the grating surface. The basket has hole 518 from which cutting edges 519 extend inwardly from the basket walls and extend toward the corn particles. The edges 519 cut or break the particles as they are pushed by the paddles 410.

Milling of Small Corn Particles

Referring back to FIG. 1, after cleaning the small corn kernels 62 are mixed with water at 64. The small kernels are tempered with water at 64, the water temperature preferably being at least about 80° C., more preferably from about 90 to 100° C. The temper is for at least about 30 seconds, preferably about 90 seconds to about 3 minutes. The tempered small corn kernels are then degermed at 72 in a degerminator which is the same as that described used for the degermination of the large corn kernels. A thrustock 76 and a tail stock stream are created as a result of the degermination. The thrustock is separated from the tail stock with the thrustock being used for feed. The tail stock is separated at 78 such as by sieving or sifting to separate particles of +5 mesh (3,987 μm) or greater from those corn particulate products with a particle size of smaller than +5 mesh (U.S. mesh sieve size) at 80. The corn meal having a particle size of greater than +5 mesh (3,987 μm) is then grated or cut at 82 to a size smaller than +5 mesh.

While particular embodiments of the present invention have been described and illustrated, it should be understood that the invention is not limited thereto since modifications may be made by persons skilled in the art. The present application contemplates any and all modifications that fall within the spirit and scope of the underlying invention disclosed and claimed herein.

What is claimed is:

1. A process of milling corn comprising:

mixing water and corn kernels to provide a tempering mixture;

holding the tempering mixture for a time and temperature which are effective for lifting hull off from the endosperm of the corn kernels, but which are not effective for moisture to substantially penetrate into the endosperm of the corn kernels;

abrasively removing germ and bran from the moistened tempered corn of the corn kernels by rubbing the moistened tempered corn against at least one screen to provide not more than 35 wt % thrustock, not more than 10 wt % bran, and at least 65 wt % tail stock, the thrustock having at least 8 wt % fat and the tail stock having less than 1.75 wt % fat.

2. The process of claim 1 wherein the tail stock has a flaking grit stream and a tail corn stream, the tail corn stream having a particle size of at least about 5,664 μm.

3. The process of claim 2 further comprising sizing the tail corn stream to a flaking grit size which is smaller than about 5,664 μm and larger than about 3,987 μm wherein the process yields at least about 25 wt % flaking grits based upon the weight of corn kernels after cleaning and prior to milling.

4. The process of claim 1 further comprising a step of separating large corn kernels from small corn kernels into a small corn component and a large corn component prior to milling.

5. The process of claim 4 wherein the steps of milling, holding, abrasively removing, and sizing are performed on the large corn component.

6. The process of claim 1 wherein the steps of milling, holding, abrasively removing, and sizing are performed on whole corn kernels.

7. The process of claim 1 which yields at least 30 wt % flaking grits based upon the weight of corn kernels prior to milling.

8. The process of claim 7 which yields at least 35 wt % flaking grits based upon the weight of corn kernels prior to milling.

9. The process of claim 8 which yields at least 38 wt % flaking grits based upon the weight of corn kernels prior to milling.

10. The process of claim 1 wherein the at least one screen has rectangular holes having a size of 1 mm to 3 mm by 20 mm to 25 mm.

11. The process of claim 3 wherein the tail corn stream is sized by grating which moves the tail corn stream with a moving surface over perforations and cutting edges to size the tail corn stream, wherein the moving surface and the size of the perforations are effective to provide flaking grits.

12. The process of claim 11 wherein the perforations over which the tail corn component is moved have a size of from 4 mm to 7 mm.

13. The process of claim 3 wherein the sizing of the tail corn stream is an abrasive sizing by pushing the corn particles against a slotted screen which produces corn particles of a flaking grit size and a residual corn particle stream which is larger than flaking grit size, the process further comprising sizing larger particles in the residual stream by grating.

14. The process of claim 1 wherein corn is abrasively sized by rubbing the moistened tempered corn against at least one screen.

15. The process of claim 1 wherein at least 90 wt % of the corn kernels have a hardness of at least 58 wt % under a Quaker hardness test.

16. The process of claim 1 wherein the holding step comprises tempering the corn kernels with moisture having a temperature of 80° C. to 100° C. for a time of 90 seconds to 3 minutes.

17. A process of milling corn comprising:

separating whole corn kernels, at least about 90 wt % of which have a hardness of at least about 58 wt % under a Quaker hardness test, into a small corn component and a large corn component;

tempering the large corn component with moisture having a temperature of about 80° C. to 100° C. for about 90 seconds to 3 minutes for lifting hull off from the endosperm of the large corn component without moisture substantially penetrating into the endosperm of the large corn component;

abrasively removing germ and bran from the moistened tempered corn by rubbing the moistened tempered corn of the large corn component against at least one screen to provide not more than 35 weight percent thrustock and at least 65 weight percent tail stock, the thrustock having at least 8 wt % fat and not more than 10 wt % bran, and the tail stock having less than 1.75 wt % fat, the tail stock having a flaking grit stream and a tail corn stream, the tail corn stream of the large corn component having a particle size of at least about 5,664 μm.

18. The process of claim 17 further comprising sizing the tail corn stream of the large corn component by rubbing the moistened tempered corn against at least one screen to provide a second flaking grit stream and a residual large particle stream.

19. The process of claim 18 further comprising separating the second flaking grit stream from the residual large particle stream; and further sizing the large particle stream from the large corn component by grating the large particle stream by moving the large particle stream with a moving surface over perforations and cutting edges to size the large particle stream, the process effective for providing flaking grits in yield of at least about 25 wt % based on the weight of the large corn kernels prior to tempering.

20. The process of claim 19 further comprising milling the small corn component by mixing water and the small corn component to provide a small corn component tempering mixture;

holding the small corn tempering mixture for a time and temperature effective for lifting hull off from the endosperm of the small corn kernels, but a time and temperature which is not effective for moisture to substantially penetrate into the endosperm of the small corn kernels of the small corn component; and abrasively removing germ and bran from the moistened tempered corn of the small corn component by rubbing the moistened tempered corn against at least one screen to provide a small corn component thrustock and a small corn component tail stock.

21. The process of claim 18 wherein the screen has rectangular holes having a size of about 1 mm to 3 mm by 20 mm to 25 mm.

22. The process of claim 19 wherein perforations have a size of from about 4 mm to 7 mm.

23. The process of claims 17 further comprising preselecting corn kernels such that at least 90 wt % of the corn kernel have a hardness of 58 to 65 wt % under a Quaker hardness test.

24. A process of milling corn comprising:

separating whole corn kernels into a small corn component and a large corn component;

milling the large corn component by mixing water and the large corn component to provide a tempering mixture;

holding the tempering mixture for a time and temperature effective for lifting hull off from the endosperm of the corn kernels, but a time and temperature which is not effective for moisture to substantially penetrate into the endosperm of the corn kernels of the large corn component;

abrasively removing germ and bran from the moistened tempered corn of the large corn component by rubbing the moistened tempered corn against at least one screen to provide not more than 35 weight percent thrustock and at least 65 weight percent tail stock, the tail stock having a flaking grit stream and a tail corn stream, the tail corn stream having a particle size of at least 3½ mesh; and sizing the tail corn stream of the large corn component to a flaking grit size which is smaller than 3½-mesh and larger than 5-mesh such that the process yields at least 38 weight percent flaking grits, based upon the weight of large corn kernels going into the process;

milling the small corn component by mixing water and the small corn component to provide a small corn component tempering mixture;

holding the small corn tempering mixture for a time and temperature effective for lifting hull off from the endosperm of the small corn kernels, but a time and temperature which is not effective for moisture to substantially penetrate into the endosperm of the small corn kernels of the small corn component; and abrasively removing germ and bran from the moistened tempered corn of the small corn component by rubbing the moistened tempered corn against at least one screen to provide a small corn component thrustock and a small corn component tail stock.

25. A process of milling corn comprising:

separating whole corn kernels into a small corn component and a large corn component;

milling the large corn component by mixing water and the large corn component to provide a tempering mixture;

holding the tempering mixture for a time and temperature effective for lifting hull off from the endosperm of the corn kernels, but a time and temperature which is not effective for moisture to substantially penetrate into the endosperm of the corn kernels of the large corn component abrasively removing germ and bran from the moistened tempered corn of the large corn component by rubbing the moistened tempered corn against at least one screen to provide not more than 35 weight percent thrustock and at least 65 weight percent tail stock, the tail stock having a flaking grit stream and a tail corn stream, the tail corn stream having a particle size of at least 3½ mesh; and sizing the tail corn stream of the large corn component to a flaking grit size which is smaller than 3½-mesh and larger than 5-mesh such that the process yields at least 38 weight percent flaking grits, based upon the weight of large corn kernels going into the process.

* * * * *